US006288712B1

(12) United States Patent
Pinkham et al.

(10) Patent No.: US 6,288,712 B1
(45) Date of Patent: Sep. 11, 2001

(54) SYSTEM AND METHOD FOR REDUCING PEAK CURRENT AND BANDWIDTH REQUIREMENTS IN A DISPLAY DRIVER CIRCUIT

(75) Inventors: Raymond Pinkham, Los Gatos; W. Spencer Worley, III, Half Moon Bay; Edwin Lyle Hudson; John Gray Campbell, both of Los Altos, all of CA (US)

(73) Assignee: Aurora Systems, Inc., San Jose, CA (US)

( * ) Notice: Subject to any disclaimer, the term of this patent is extended or adjusted under 35 U.S.C. 154(b) by 0 days.

(21) Appl. No.: 08/970,665

(22) Filed: Nov. 14, 1997

(51) Int. Cl.[7] ..... G09G 5/00; G09G 3/36

(52) U.S. Cl. ..... 345/204; 345/214; 345/87; 345/90; 345/98

(58) Field of Search ..... 345/214, 215, 345/204, 33, 42, 51, 90, 93, 98, 100, 103, 92, 87, 88, 99

(56) References Cited

U.S. PATENT DOCUMENTS

| | | | | |
|---|---|---|---|---|
| 5,028,916 | * | 7/1991 | Ichikawa et al. | 340/784 |
| 5,278,652 | | 1/1994 | Urbanus et al. | 358/160 |
| 5,339,116 | | 8/1994 | Urbanus et al. | 348/716 |
| 5,523,803 | | 6/1996 | Urbanus et al. | 348/771 |
| 5,844,535 | * | 12/1998 | Itoh et al. | 345/92 |
| 5,945,972 | * | 8/1999 | Okumura et al. | 345/98 |
| 6,107,979 | * | 8/2000 | Chiu et al. | 345/84 |

FOREIGN PATENT DOCUMENTS 0 256 879 * 2/1988 (EP) ..... G09G/3/36

OTHER PUBLICATIONS

Texas Instruments, TTL Data Book vol. 2, pp. 1–24, 2–159, 2–545 and notice page.*

* cited by examiner

*Primary Examiner*—Bipin Shalwala
*Assistant Examiner*—Jimmy H. Nguyen
(74) *Attorney, Agent, or Firm*—Henneman & Saunders; Larry E. Henneman, Jr.

(57) ABSTRACT

A display driver circuit for reducing system interface band width requirements and peak current requirements includes a select line sequencer, for providing a series of select line addresses on an address terminal set, and a select line decoder coupled to the address terminal set, for decoding each of the select line addresses and asserting an update signal on a corresponding one of a plurality of output terminals. Optionally, the select line sequencer generates a series of select sub-line addresses, and the select line decoder is a select sub-line decoder. An optional select address register receives initial select addresses from a system and provides the initial select addresses to the select line sequencer. An alternate display driver circuit including a select line sequencer and a select sub-line sequencer is also described.

18 Claims, 9 Drawing Sheets

| OP[2] | OP[1] | OP[0] | Functions |
|---|---|---|---|
| 0 | 0 | 0 | No OP |
| 0 | 0 | 1 | Data Write. Load D[31:0] into next position of the Write Hold Register |
| 0 | 1 | 0 | Write Line |
| 0 | 1 | 1 | Load Row Address into Row Decoder |
| 1 | 0 | 0 | Change Pixel States |
| 1 | 0 | 1 | Load Select Address Register |

700

SYSTEM AND METHOD FOR REDUCING PEAK CURRENT AND BANDWIDTH REQUIREMENTS IN A DISPLAY DRIVER CIRCUIT

BACKGROUND OF THE INVENTION

1. Field of the Invention

This invention relates generally to circuits for driving electronic displays, and more particularly to a system and method for using an internal sequencer to sequentially drive the select lines of a display.

2. Description of the Background Art

FIG. 1 shows a prior art display driver circuit 100, for driving a display 102 which includes an array of pixel cells arranged in 768 rows and 1024 columns. Display driver circuit 100 includes select decoder 104, row decoder 106, write hold register 108, pointer 110, instruction decoder 112, invert logic 114, timing generator 116, and input buffers 118, 120, and 122. Driver circuit 100 receives clock signals via an SCLK terminal 124, invert signals via an invert (INV) terminal 126, data and addresses via a 32-bit system data bus 128, and operating instructions via a 3-bit op-code bus 130, all from a system (e.g., a computer) not shown. Timing generator 116 generates timing signals, by methods well known to those skilled in the art, and provides these timing signals to the components of driver circuit 100 via clock signal lines (not shown) to coordinate the operation of the various components.

Invert logic 114 receives the invert signals from the system via INV terminal 126 and buffer 118, and receives the data and addresses from the system via system data bus 128 and buffer 120. Responsive to a first invert signal ($\overline{\text{INV}}$), invert logic 114 asserts the received data and addresses on a 32-bit internal data bus 132. Responsive to a second invert signal (INV), invert logic asserts the complement of the received data on internal data bus 132. Internal data bus 132 provides the asserted data to write hold register 108, and provides the asserted addresses to select decoder 104, via 5 of the 32 lines, and to row decoder 106, via 10 of the 32 lines.

Instruction decoder 112 receives opcode instructions from the system, via op-code bus 130 and buffer 122, and, responsive to the received instructions, provides control signals, via an internal control bus 134, to select decoder 104, row decoder 106, write hold register 108, and pointer 110. Responsive to the system asserting data on system data bus 128 and a first instruction (i.e., Data Write) on op-code bus 130, instruction decoder 112 asserts control signals on control bus 134, causing write hold register 108 to load the asserted data via internal data bus 132 into a first portion of write hold register 108. Because internal data bus 132 is only 32 bits wide, 32 data write commands are necessary to load an entire line (1024 bits) of data into write hold register 108. Pointer 110 provides an address, via a set of address lines 135, to write hold register 108, identifying the portion of write hold register 108 to which data is to be written. As each successive Data Write command is executed, pointer 110 increments the address asserted on lines 135 to identify the next 32-bit portion of write hold register 108.

Responsive to the system asserting a row address on system data bus 128 and a second instruction (i.e., Load Row Address) on op-code bus 130, instruction decoder 112 asserts control signals on control bus 134 causing row decoder 106 to store the asserted row address. Then, responsive to the system asserting a third instruction (i.e., Array Write) on op-code bus 130, instruction decoder 112 asserts control signals on control bus 134, causing write hold register 108 to assert the 1024 bits of stored data on a set of 1024 data output terminals 136, and causing row decoder 106 to decode the stored row address and assert a write signal on one of 768 word-lines 138 corresponding to the decoded row address. The write signal on the corresponding word-line causes the data being asserted on data output terminals 136 to be latched into a corresponding row of pixel cells in display 102.

Responsive to the system asserting a block address on system data bus 128 and a fourth instruction (i.e., Load Block Address) on op-code bus 130, instruction decoder 112 asserts control signals on control bus 134, causing select decoder 104 to store the asserted block address. Then, responsive to the system asserting a fifth instruction (i.e., Pixel Update) on op-code bus 130, instruction decoder 112 asserts control signals on control bus 134 causing select decoder 104 to decode the asserted address and assert a block update signal on one of a group of 24 block select lines 140 corresponding to the decoded block address. The block update signal on the corresponding block select line causes all of the pixels cells of an associated block to assert the previously latched data onto their associated pixel electrodes (not shown in FIG. 1).

FIG. 2 shows an exemplary dual-latch pixel cell 200(*r,c,b*) of display 102, where (*r*), (*c*), and (*b*) indicate the row, column, and block of the pixel cell, respectively. Pixel cell 200 includes a master latch 202, a slave latch 204, a pixel electrode 206, and switching transistors 208, 210, and 212. Master latch 202 is a static random access memory (SRAM) latch. One input of master latch 202 is coupled, via transistor 208, to a Bit+data line 214(*c*), and the other input of master latch 202 is coupled, via transistor 210, to a Bit−data line 216(*c*). The gate terminals of transistors 208 and 210 are coupled to word line 138(*r*). The output of master latch 202 is coupled, via transistor 212, to the input of slave latch 204. The gate terminal of transistor 212 is coupled to block select line 140(*b*). The output of slave latch 204 is coupled to pixel electrode 206.

A write signal on word line 138(*r*) places transistors 208 and 210 into a conducting state, causing the complementary data asserted on data lines 214(*c*) and 216(*c*) to be latched, such that the output of master latch 202 is at the same logic level as data line 214(*c*). A block select signal on block select line 140(*b*) places transistor 212 into a conducting state, and causes the data being asserted on the output of master latch 202 to be latched onto the output of slave latch 204, and thus onto coupled pixel electrode 206.

FIG. 3 illustrates how display 102 is divided into 24 blocks (0–23), each containing 32 rows, for purposes of updating the pixel cells. Each block contains 32 rows of pixel cells, all coupled to one block select line 140(*b*). Accordingly, all of the pixel cells of a given block are updated simultaneously. The division of a display into blocks for the purpose of updating the pixel cells is further described in U.S. Pat. No. 5,278,652, which issued to Urbanus et al. on Jan. 11, 1994, and is incorporated herein by reference.

FIG. 4 shows the temporal relationship of the pixel updates. During the first SCLK cycle, a load address (LA) command loads the address of the first block to be updated (Block 0). Then, during the next clock cycle, an update block command (UB) causes all of the pixel cells in Block 0 to be updated. This two-step sequence of loading an address and updating a block is repeated until each of the blocks in the display are updated.

FIG. 5 shows the temporal relationship of the row updates within a block. In particular, note that all rows within a block are updated simultaneously. For example, Rows 0–31 of Block 0 are all updated responsive to the first update block command. Similarly, Rows 0–31 of Block 1 are all updated responsive to the second update block command. This is because all of the pixels within a block are coupled to a common select line.

The above described prior art suffers a disadvantage, in that simultaneously updating all of the pixels within a block generates a relatively large amount of peak current. For example, for blocks having 32 rows of 1024 pixels, 32,768 pixel electrodes must be charged (or discharged) at one time. Furthermore, in the prior art, the number of rows in each block cannot be substantially decreased, because the decrease would result in an increased number of blocks, and an unacceptable system interface bandwidth requirement to perform the increased number of block updates.

What is needed, therefore, is a display driver circuit with a reduced peak current requirement and a reduced system interface bandwidth requirement.

SUMMARY

A novel display driver circuit is described. The display driver circuit includes a select line sequencer, for providing a series of select line addresses at an output, and a select line decoder coupled to the output of the select line sequencer, for decoding each of the select line addresses and asserting an update signal on a corresponding one of a plurality of output terminals. Optionally, the select line sequencer generates a series of select sub-line addresses, and the select line decoder is a select sub-line decoder.

Optionally, the display driver circuit includes a select address register coupled to the select line sequencer for providing an initial select line address to the select line sequencer, and an input terminal for receiving another initial select line address. It should be understood that receiving an initial select line address is interpreted to include receiving a block address and converting the block address to an initial select line address. The select line sequencer further includes a control input terminal for receiving control signals. Responsive to a first control signal, the select line sequencer outputs the next address of the series of select line addresses. Responsive to a second control signal, the select line sequencer outputs a new series of select line addresses starting from the other initial select line address provided by the select address register.

In a particular embodiment, the display driver circuit further includes a select sub-line sequencer, for providing a series of select sub-line addresses on an address terminal set, and a select sub-line decoder coupled to the address terminal set, for decoding each of the select sub-line addresses and asserting an update signal on a corresponding one of a plurality of output terminals.

A novel method for updating a display is also disclosed. The method includes the steps of receiving a first initial select line address from a system, generating a series of select line addresses based on the first initial select line address, decoding each of the select line addresses of the series, and asserting a series of update signals on a first group of output terminals, each terminal of the first group corresponding to an associated select line address. Optionally, the method includes the steps of receiving another initial select line address, and generating another series of select line addresses based on the another initial select line address. Optionally, the method further includes the steps of generating a series of select sub-line addresses, decoding each of the select sub-line addresses of the series, and asserting a series of update signals on a second group of output terminals, each terminal of the second group corresponding to an associated select sub-line address.

An alternate method includes the steps of receiving a first initial select sub-line address from a system, generating a series of select sub-line addresses based on the first initial select sub-line address, decoding each of the select sub-line addresses of the series, and asserting a series of update signals on a plurality of output terminals, each terminal of the plurality of output terminals corresponding to an associated select sub-line address.

It should be understood that receiving an initial select line address is interpreted to include receiving a block address and converting the block address to an initial select line address. Similarly, it should be understood that receiving an initial select sub-line address is interpreted to include receiving a block address and converting the block address to an initial select sub-line address.

BRIEF DESCRIPTION OF THE DRAWINGS

The present invention is described with reference to the following drawings, wherein like reference numbers denote substantially similar elements.

DETAILED DESCRIPTION

This patent application is related to the following co-pending patent applications, filed on even date herewith and assigned to a common assignee, each of which is incorporated herein by reference in its entirety:

De-Centered Lens Group For Use In An Off-Axis Projector, Ser. No. 08/970,887, now issued as U.S. Pat. No. 6,076,931, Matthew F. Bone and Donald Griffin. Koch;

System And Method For Using Forced States To Improve Gray Scale Performance Of A Display, Ser. No. 08/970,878, now issued as U.S. Pat. No. 6,072,452, W. Spencer Worley, III and Raymond Pinkham;

System And Method For Data Planarization, Ser. No. 08/970,307, now issued as U.S. Pat. No. 6,144,356, William Weatherford, W. Spencer Worley, III, and Wing Chow; and Internal Row Sequencer For Reducing Bandwidth And Peak Current Requirements In A Display Driver Circuit, Ser. No. 08/970,443, Raymond Pinkham, W. Spencer Worley, III, Edwin Lyle Hudson, and John Gray Campbell.

This patent application is also related to co-pending patent application Ser. No. 08/901,059, entitled Replacing Defective Circuit Elements By Column And Row Shifting In A Flat Panel Display, by Raymond Pinkham, filed Jul. 25, 1997, assigned to a common assignee, and is incorporated herein by reference in its entirety.

The present invention overcomes the problems associated with the prior art, by implementing an internal select line sequencer, to reduce both the peak current and the system interface bandwidth in a display driver circuit. In the following description, numerous specific details are set forth (e.g., op-code instructions, data and address bus bit-widths, and the number and organization of display pixels) in order to provide a thorough understanding of the invention. Those skilled in the art will recognize, however, that the invention may be practiced apart from these specific details. In other instances, details of well known display driving techniques (e.g., pulse-width modulation) and circuitry have been omitted, so as not to unnecessarily obscure the present invention.

Figure 6:
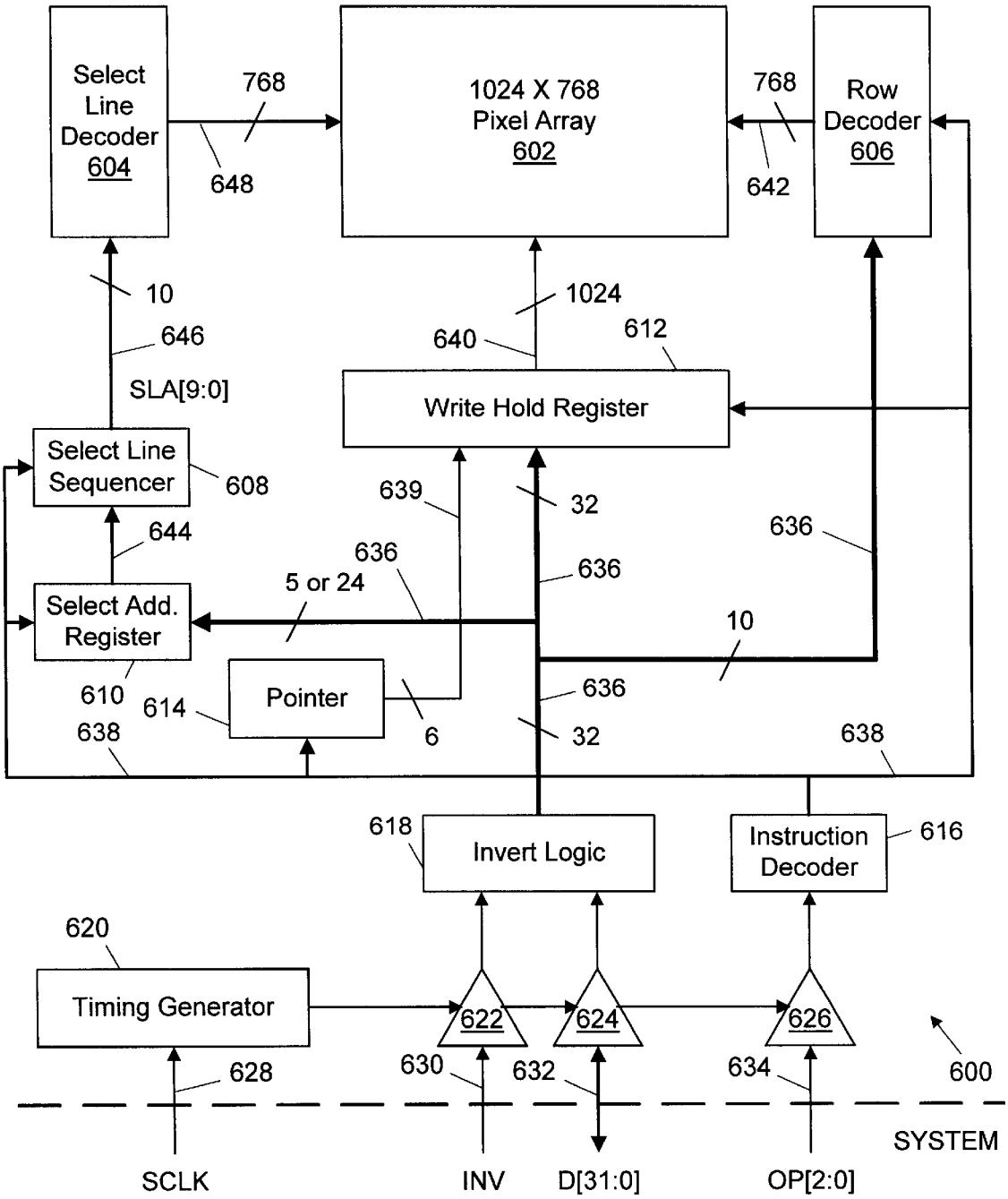
FIG. 6 is a block diagram of one embodiment of a display driver circuit, in accordance with the present invention.

FIG. 6 shows a display driver circuit 600, for driving a display 602 which includes an array of pixel cells arranged in 768 rows and 1024 columns. Display driver circuit 600 includes select decoder 604, row decoder 606, select line sequencer 608, select address register 610, write hold register 612, pointer 614, instruction decoder 616, invert logic 618, timing generator 620, and input buffers 622, 624, and 626. Driver circuit 600 receives clock signals via an SCLK terminal 628, invert signals via an invert (INV) terminal 630, data and addresses via a 32-bit system data bus 632, and operating instructions via a 3-bit op-code bus 634, all from a system (e.g., a computer, video signal source, etc.) not shown. Timing generator 620 generates timing signals, by methods well known to those skilled in the art, and provides these timing signals to the various components of driver circuit 600, via clock signal lines (not shown), to coordinate the operation of each of the components.

Invert logic 618 receives the invert signals from the system via INV terminal 630 and buffer 622, and receives the data and addresses from the system via system data bus 632 and buffer 624. Responsive to a first invert signal ($\overline{\text{INV}}$), invert logic 618 asserts the received data and addresses on a 32-bit internal data bus 636. Responsive to a second invert signal (INV), invert logic 618 asserts the complement of the received data on internal data bus 636. Internal data bus 636 provides the asserted data to write hold register 612, and provides the asserted addresses to select address register 610, via 5 (or 24) lines of internal data bus 636, and to row decoder 606, via 10 lines of internal data bus 636.

Instruction decoder 616 receives opcode instructions from the system, via op-code bus 634 and buffer 626, and, responsive to the received instructions, provides control signals, via an internal control bus 638, row decoder 606, select line sequencer 608, select address register 610, write hold register 612, and pointer 614.

Figures 7, 8:
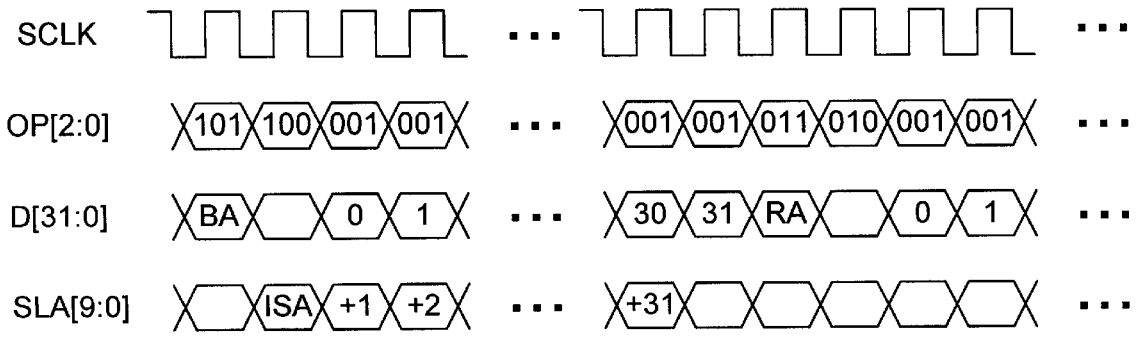
FIG. 7 is an operation code table for use with the display driver circuit of FIG. 6.
FIG. 8 is a timing diagram showing concurrent pixel updating and data loading.

FIG. 7 shows a table 700, which sets forth op-code instructions for use with display driver circuit 600. Each operation is explained with reference to FIG. 6. Op-code (000) corresponds to a No Op instruction, to which instruction decoder 616 does not respond. Responsive to the system asserting data on system data bus 632 and a Data Write command (001) on op-code bus 634, instruction decoder 616 asserts control signals on control bus 638, causing write hold register 612 to load the asserted data, via internal data bus 636, into a first portion of write hold register 612. Because internal data bus 636 is only 32 bits wide, 32 data write commands are necessary to load an entire line (1024 bits) of data into write hold register 612. Pointer 614 provides an address, via a set of address lines 639, to write hold register 612, the address indicating the portion of write hold register 612 to which data is to be written. As each successive Data Write command is executed, pointer 614 increments the address to indicate the next 32-bit portion of write hold register 612.

Responsive to the system asserting a row address on system data bus 632 and a Load Row Address command (011) on op-code bus 634, instruction decoder 616 asserts control signals on control bus 638 causing row decoder 606 to store the asserted row address. Then, responsive to the system asserting a Array Write command (010) on op-code bus 634, instruction decoder 616 asserts control signals on control bus 638, causing write hold register 612 to assert the 1024 bits of stored data on a set of data output terminals 640, and causing row decoder 606 to decode the stored row address and assert a write signal on one of a set of 768 word-lines 642 corresponding to the decoded row address. The write signal being asserted on the corresponding word-line causes the data being asserted on data output terminals 640 to be latched into a corresponding row of pixel cells of display 602.

Responsive to the system asserting a block address on system data bus 632 and a Load Select Address Register (101) on op-code bus 634, instruction decoder 616 asserts control signals on control bus 638, causing select address register 610 to store the asserted block address, and provide the address, via a set of address lines 644, to select line sequencer 608. Then, responsive to the system asserting a Change Pixel States command (100) on op-code bus 634, instruction decoder 616 asserts control signals on control bus 638 causing select line sequencer 608 to receive the stored block address from select address register 610, convert the received block address to an initial select line address (e.g., the address of the first row in the block), and assert the initial select line address on address lines 646 (SLA[9:0]). Optionally, select address register 610 includes conversion circuitry for converting the row address to an initial select line address, and provides the select line address to select line sequencer 608. The assertion of the initial select line address on address lines 646 causes select decoder 604 to decode the initial select line address and assert a pixel update signal on one of 768 select lines 648 corresponding to the initial select line address. The pixel update signal on the corresponding select line causes all of the pixels cells of an associated row to assert the previously latched data onto their associated pixel electrodes (not shown in FIG. 6). Those skilled in the art will recognize that the conversion of the block address to the initial select line address is unnecessary if the system is capable of providing select line addresses directly.

Responsive to subsequent SCLK cycles, select line sequencer 608 generates a series of select line addresses based on the initial select line address, and asserts the series of select line addresses on address lines 646. In response to the series of select line addresses being asserted on address lines 646, select line decoder 604 decodes each of the select line addresses and asserts pixel update signals on corresponding ones of select lines 648.

Those skilled in the art will recognize that any desirable series of select line addresses may be generated. For example, the series may continually repeat itself, or may proceed only through a predetermined number of addresses and then stop. Additionally, the series may increment or decrement by some set value (e.g., 1, 2, or 3), or follow some other predetermined sequence. In an alternate embodiment, the system provides a 24-bit block address to select address register 610, each bit corresponding to one block of pixel rows in display 602, the value of the bit indicating whether or not the corresponding block is to be updated. Select line sequencer 608 then generates a series of select line addresses including the select line addresses in the blocks which are to be updated, and omitting the select line addresses in the blocks which are not to be updated.

In a simple case, the series of select line addresses generated by select line sequencer 608 is a monotonic, increasing series (e.g., incremented by 1), which begins at the initial select line address, cycles through one block (32) of address lines, and then stops. In this simple case, it appears to the system that all the pixels in the block are updated simultaneously in response to a single Change Pixel States command. To update the next block of pixel cells, the system provides another block address on system data bus 632 and a Load Select Line Register command on op-code bus 634, to load the new block address into select address register 610. Select line sequencer 608, then converts the new block address to another initial select line address, and generates another series of select line addresses based on the new initial select line address. Select line decoder decodes the new series of select line addresses, and updates the corresponding rows of pixel cells.

FIG. 8 is a timing diagram showing a pixel block being updated while data is being loaded. During the first SCLK cycle, the system asserts a Load Select Address Register command (101), causing select address register 610 to load the block address (BA) being asserted on system data bus 632. During the next SCLK cycle, the system asserts a Change Pixel States command (100), causing select line sequencer 608 to assert the initial select line address on address lines 646 (SLA[9:0]), thus updating, via decoder 604, the first row of the block. During the third clock cycle, the system asserts a Data Write command, causing 32 bits of data to be loaded into the first (0th) portion of write hold register 612. Also during the third SCLK cycle, select line sequencer 608 asserts the next select line address (ISA+1) on address lines 646, causing the next row of pixel cells in the block to be updated. This sequence continues until all rows in the block have been updated. It should be understood that the commands issued subsequent to the Change Pixel States command (100) are not necessary to effect the sequential updating of the rows of the block. The subsequent commands are shown only to point out that other commands can be executed concurrently with the sequential updating of a block.

From outside of display driver circuit 600, it appears that the entire block is updated at once, because only one Change Pixel States command (100) is required to update the entire block. In reality, however, because of the internal sequencing of the select lines, the updating of each row of pixels is temporally offset from the previous row, thus greatly reducing the peak current requirements. Furthermore, because only one Change Pixel States command (100) is required to update several discrete groups of pixels (e.g., rows or groups of rows), the system interface bandwidth requirement is also reduced.

Figure 1:
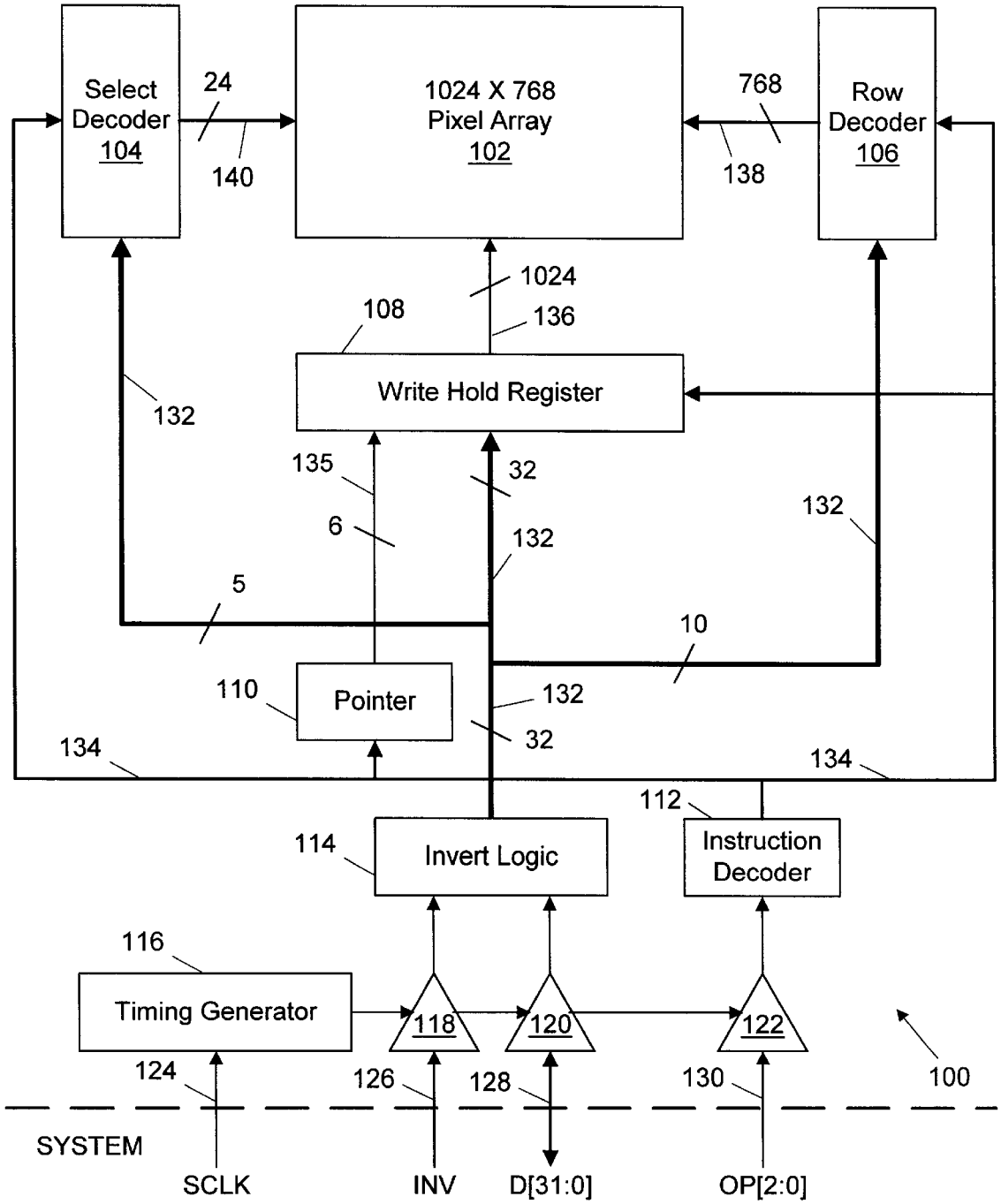
FIG. 1 Prior Art
FIG. 1 is a block diagram of a prior art display driver circuit.
Figure 2:
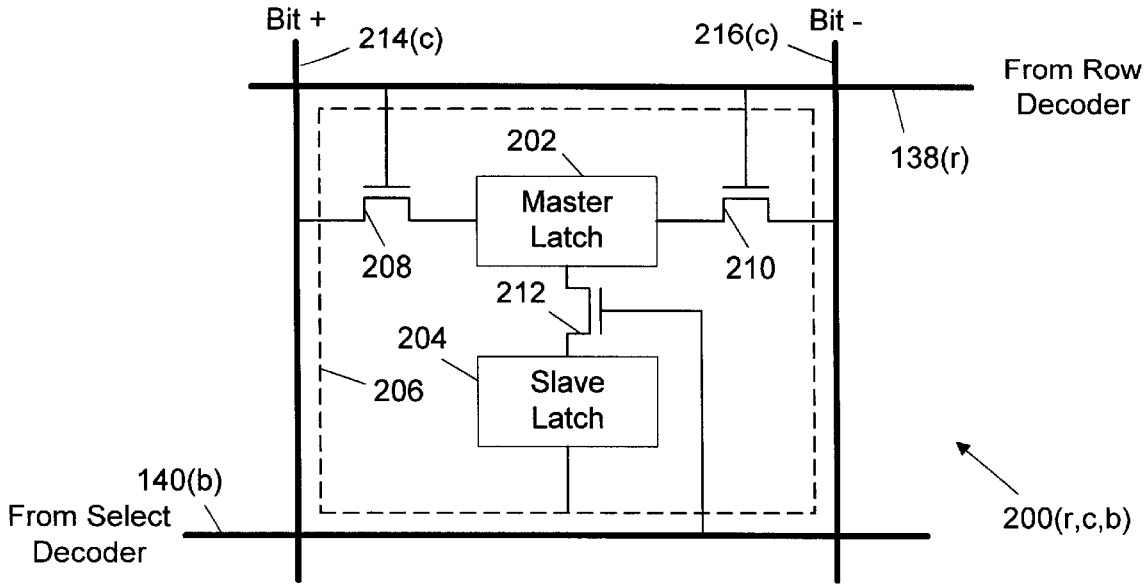
FIG. 2 Prior Art
FIG. 2 is a block diagram of a prior art, dual-latched pixel cell.
Figure 3:
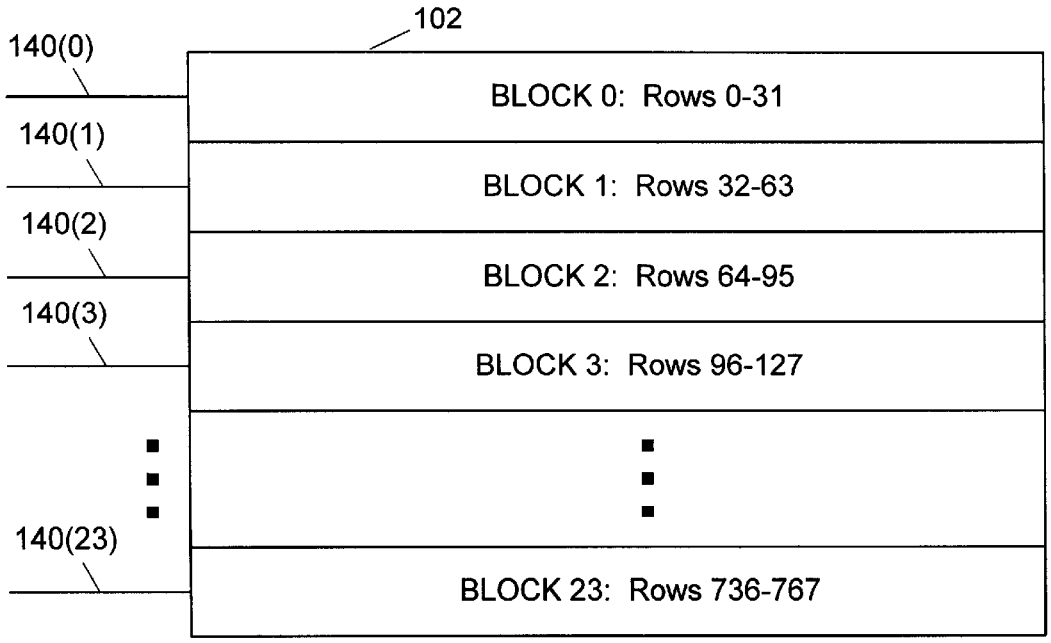
FIG. 3 Prior Art
FIG. 3 illustrates the division of a display into blocks of rows.
Figure 4:
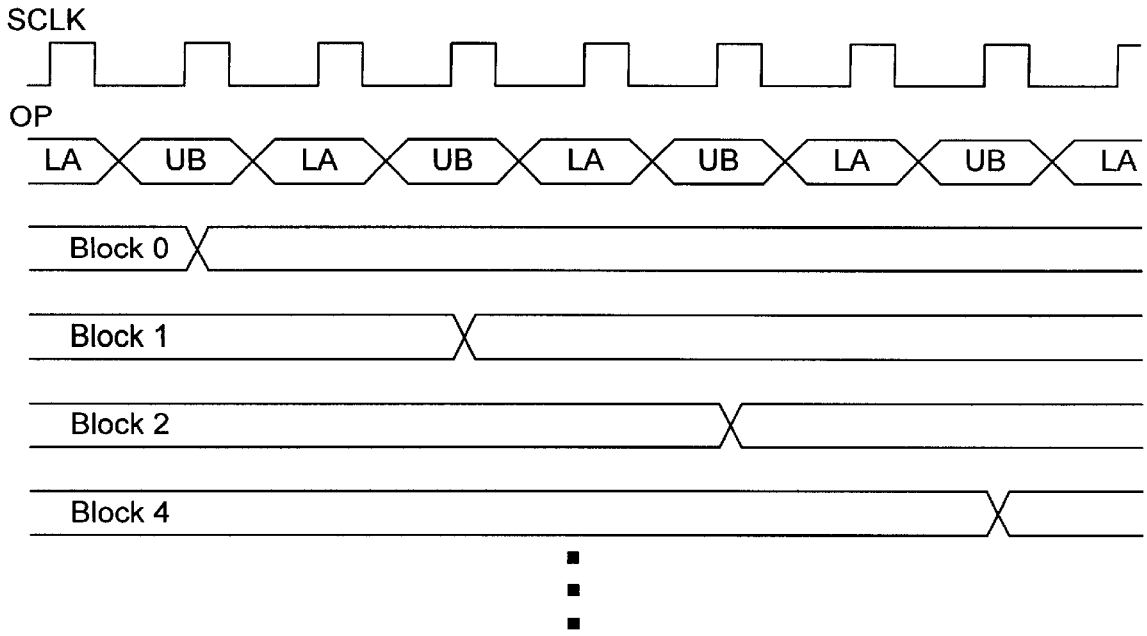
FIG. 4 Prior Art
FIG. 4 is a timing diagram showing the updating of blocks of pixel cells.
Figure 5:
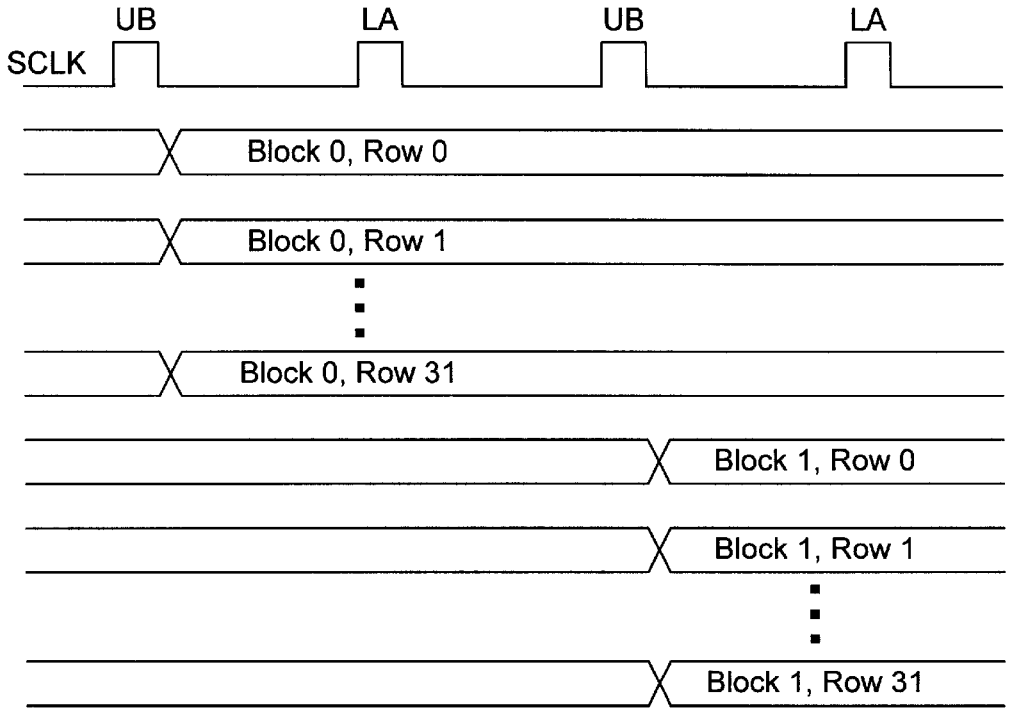
FIG. 5 Prior Art
FIG. 5 is a timing diagram showing the updating of rows of pixel cells within a block.
Figure 9:
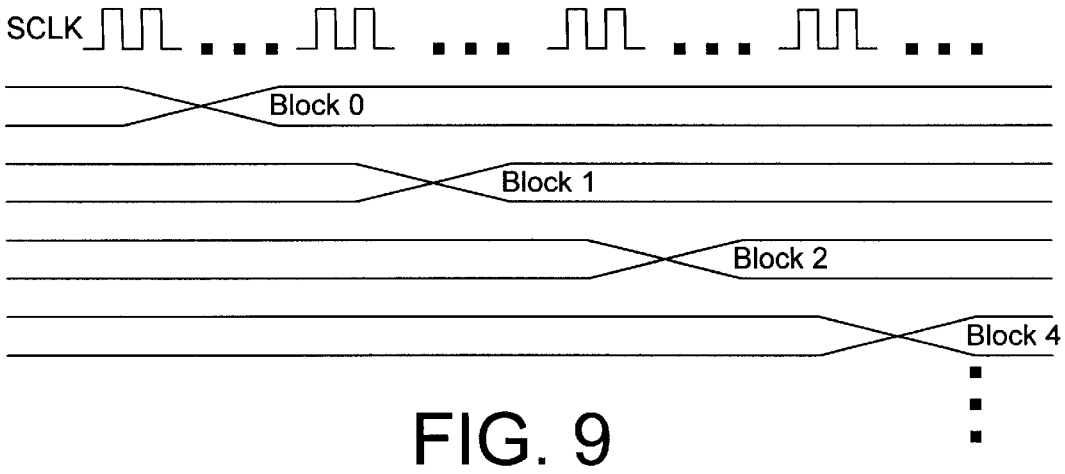
FIG. 9 is a timing diagram showing the updating of blocks of pixel cells, in accordance with the present invention.

FIG. 9 shows the effect of the internal sequencing on the block updates. In particular, the updating of each block is spread over a longer time interval (compare to FIG. 4). For example, if a block contains 32 rows, and each row is updated individually, then the block update is spread over at least 32 clock cycles.

Figure 10:
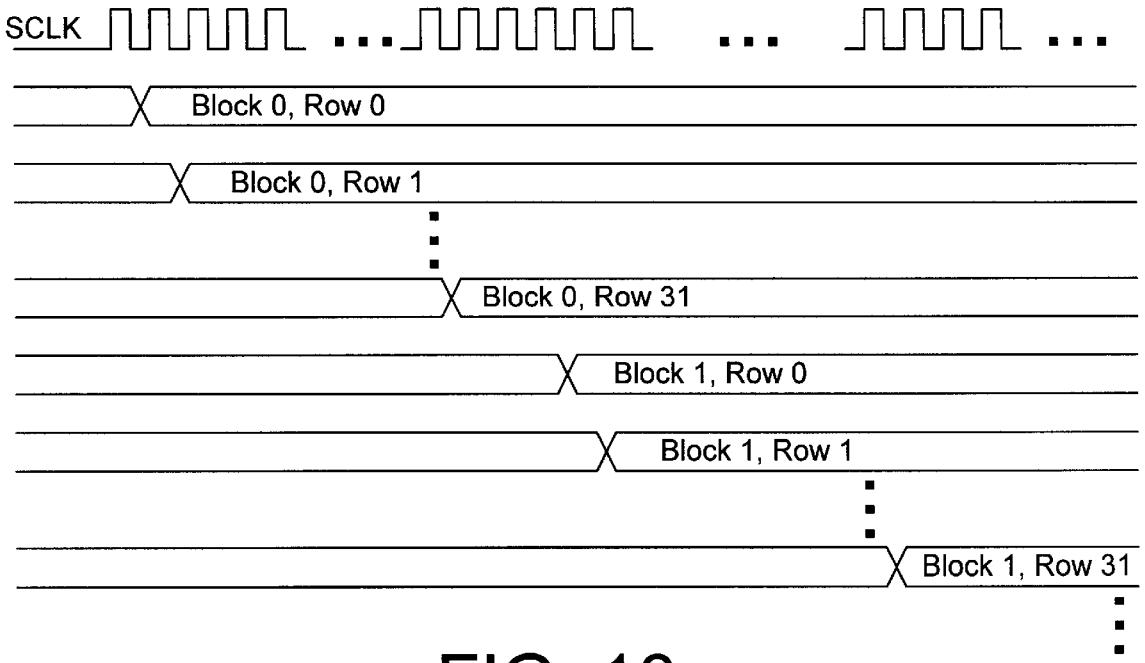
FIG. 10 is a timing diagram showing the updating of rows of pixel cells within a block, in accordance with the present invention.

FIG. 10 shows the temporal offset between the updates of rows within blocks. Row 0 of Block 0 updates on the falling edge of the first clock cycle, Row 1 of Block 0 updates on the falling edge of the second clock cycle, and so on. While each row update is shown to be separated temporally from the previous row update by one clock cycle, those skilled in the art will understand that the row updates may be temporally offset by a greater number of clock cycles, without diminishing the effectiveness of the invention.

Figure 11:
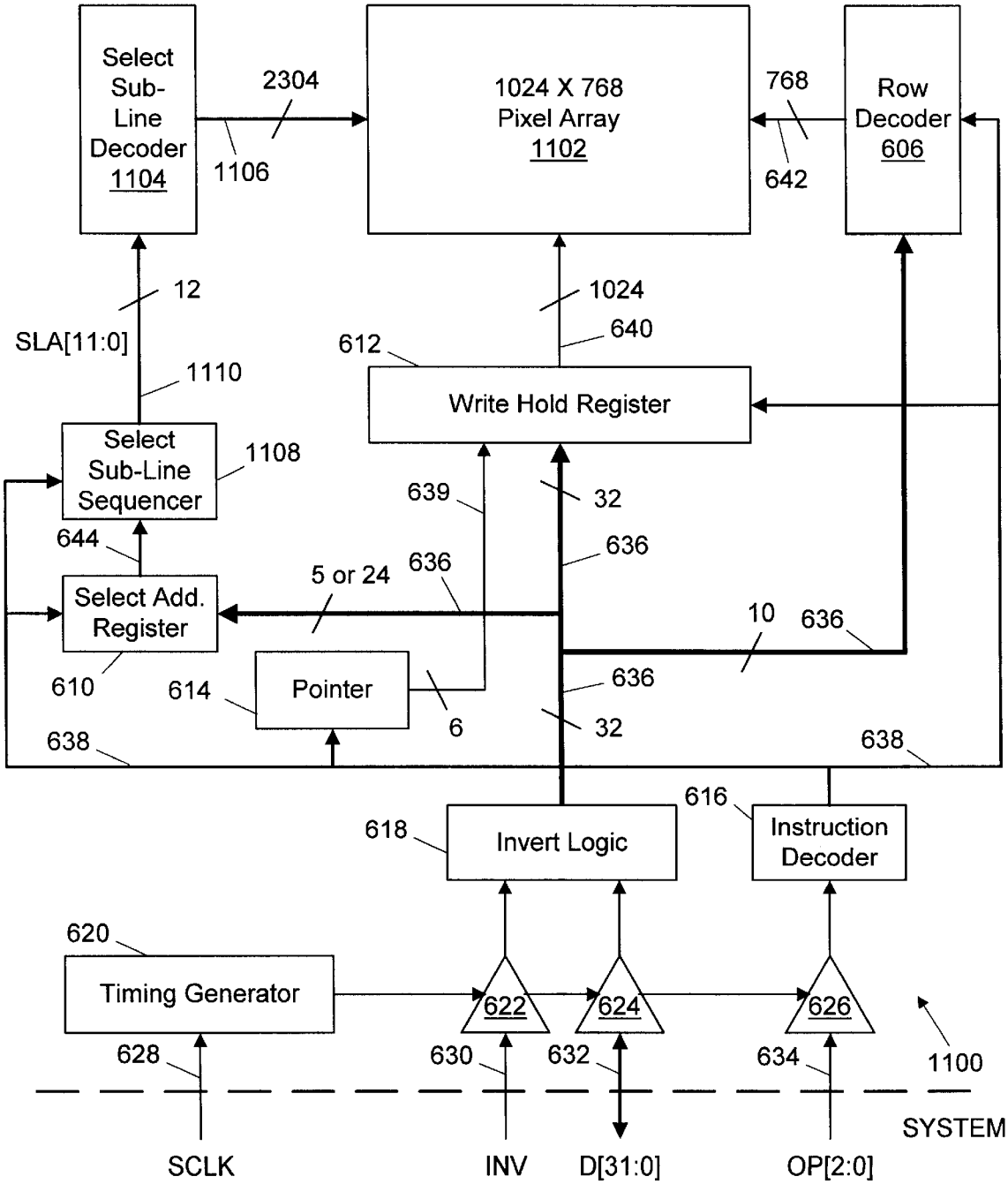
FIG. 11 is a block diagram of a second embodiment of a display driver circuit, in accordance with the present invention.

FIG. 11 shows an alternate display driver circuit 1100, for driving a display 1102 which includes an array of pixel cells arranged in 768 rows and 1024 columns. Display 1102 is similar to display 602, except that each of the 768 rows is divided into 3 sub-rows, such that each row update may be temporally spread over at least 3 clock cycles (1 for each sub-row), further reducing the peak current requirement as compared to display driver 600 which updates an entire row at a time.

Driver circuit 1100 is similar to driver circuit 600, except that select line decoder 604 is replaced by select sub-line decoder 1104, which is coupled to 2304 select sub-lines 1106, each corresponding to one of the 2304 (768×3) sub-lines of display 1102. Further, select line sequencer 608 is replaced with select sub-line sequencer 1108, which converts a received block address into a 12-bit initial select sub-line address, generates a series of 12-bit select sub-line addresses based on the initial select sub-line address, and asserts the generated addresses on address lines 1110. Select sub-line decoder 1104 decodes each of the select sub-line addresses of the generated series and asserts an update signal on a corresponding one of the select sub-lines 1106.

Those skilled in the art will recognize that select sub-line decoder 1108 can be designed to generate any desirable series of select sub-line addresses, providing great flexibility in updating display 1102. In a simple case, select sub-line decoder receives a block address, converts the block address to the address of the first select sub-line in the block, and sequentially updates each sub-row in the block.

Figure 12:
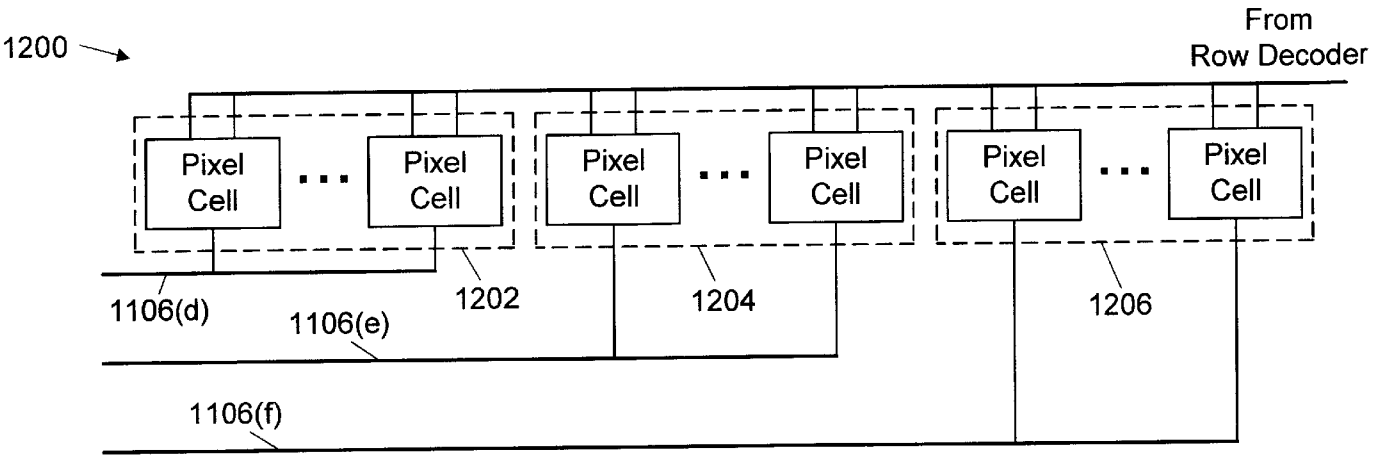
FIG. 12 is a block diagram showing one row of pixel cells of the display of FIG. 11.

FIG. 12 shows one row 1200 of pixel cells (data lines not shown) of display 1102. Row 1200 is divided into 3 sub-rows 1202, 1204, and 1206, which are serviced by 3 separate select sub-lines 1106(*d*), 1106(*e*), and 1106(*f*), respectively. Each sub-row 1202, 1204, and 1206 is updated when select sub-line decoder 1104 (FIG. 11) asserts an update signal on associated select sub-lines 1106(*d*), 1106(*e*), and 1106(*f*), respectively.

Figure 13:
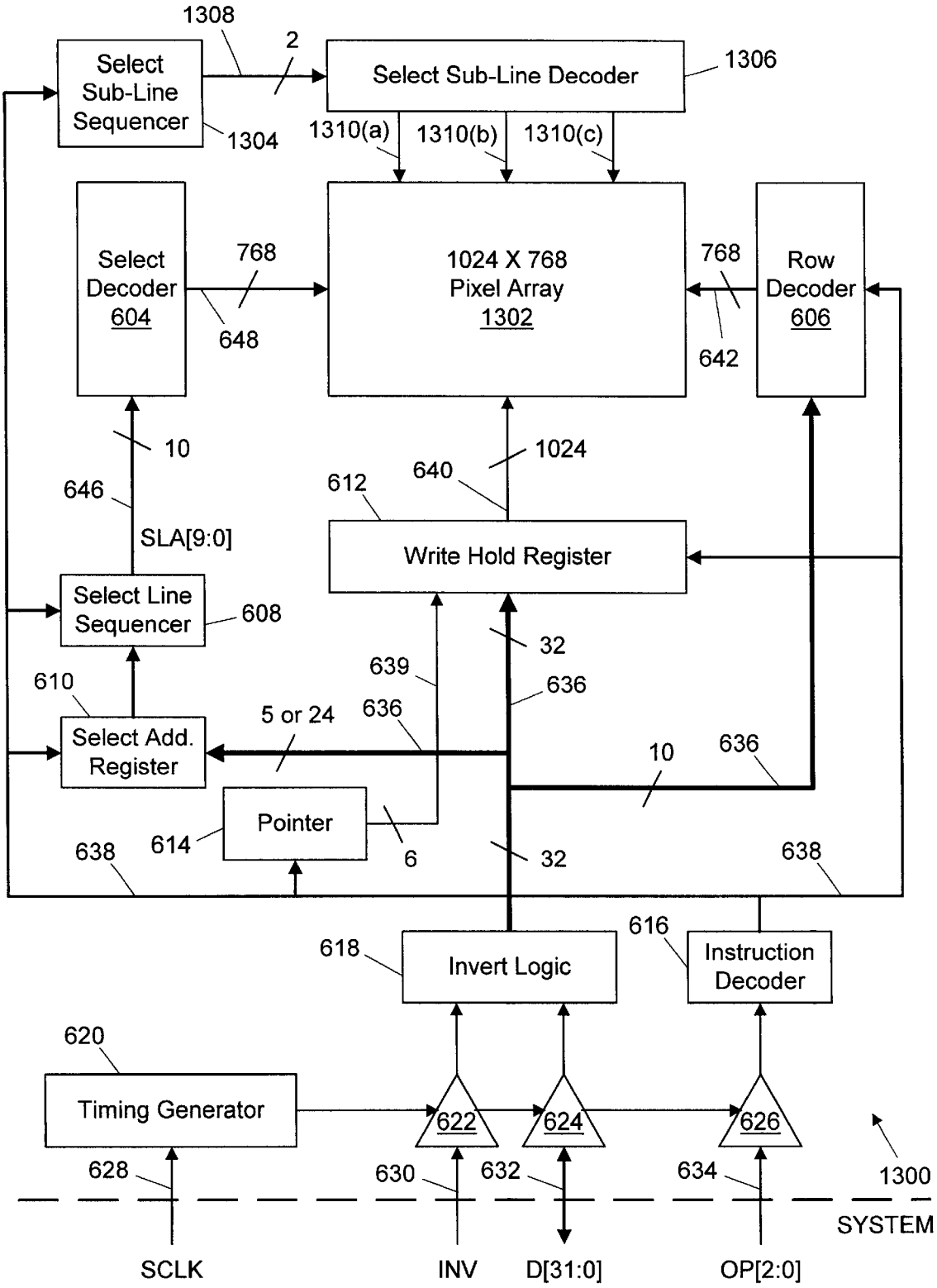
FIG. 13 is a block diagram of a third embodiment of a display driver circuit, in accordance with the present invention.

FIG. 13 shows another alternate display driver circuit 1300, for driving a display 1302. Display 1302 is similar to display 1102 except that each sub-row is serviced by one select line and one select sub-line. A particular sub-row is updated when update signals are simultaneously asserted on the select line and the select sub-line associated with the particular sub-row, as will be explained below with reference to FIG. 14.

Display driver circuit 1300 is substantially similar to display driver circuit 600, except for the addition of select sub-line sequencer 1304 and select sub-line decoder 1306.

Select sub-line sequencer 1304 generates a series of select sub-line addresses, and communicates the addresses, via a set of address lines 1308, to select sub-line decoder 1306, which decodes each address and asserts an update signal on a corresponding one of a set of select sub-lines 1310(*a–c*).

Select line sequencer 608 and select sub-line sequencer 1304 operate together to sequentially update the sub-rows of display 1302. Responsive to the system asserting a Change Pixel States command (100) on op-code bus 634, instruction decoder 616 asserts control signals on control bus 638 causing select line sequencer 608 to generate a series of select line addresses, as described above with respect to FIG. 6. The control signals asserted by instruction decoder 616 also cause select sub-line sequencer 1304 to generate a series of select sub-line addresses.

The series of select line addresses is synchronized with the series of select sub-line addresses to update a block of pixel cells as follows. Select line sequencer 608 asserts an initial select line address on address lines 646, causing select decoder 604 to assert an update signal on a first one of select lines 648 corresponding to an initial row of the block being updated. At the same time, select sub-line sequencer 1304 asserts an initial select sub-line address on address lines 1308, causing select sub-line decoder 1306 to assert an update signal on select sub-line 1310(*a*). The two concurrent update signals cause the first sub-row of the initial row to be updated. Next, while the initial select line address is still being asserted by select line sequencer 608, select sub-line sequencer 1308 sequentially asserts the next two select sub-line addresses on address lines 1308, causing select sub-line decoder 1306 to sequentially assert update signals on select sub-lines 1310(*b*) and 1310(*c*), sequentially updating the second and third sub-rows of the initial row. As select line sequencer 608 asserts each successive select line address of the series, select sub-line sequencer reasserts the series of select sub-line addresses, thus updating each row of the block one sub-row at a time.

The series of select line addresses is synchronized with the series of select sub-line addresses at the SCLK level. In particular, a common control signal initiates the assertion of the first address by both select line sequencer 608 and select sub-line sequencer 1304. After the assertion of the initial addresses, select sub-line sequencer 1304 asserts the next address in the series of select sub-line addresses every clock cycle, whereas select line sequencer 608 asserts the next address in the series of select line addresses every third clock cycle.

Those skilled in the art will recognize that there are many other ways to synchronize the series of select line addresses with the series of select sub-line addresses. For example, in an alternate embodiment, select sub-line sequencer 1304 and select line sequencer 608 are replaced with a single sequencer that generates a 12 bit address, the 2 least significant bits of the address being provided to select sub-line decoder 1306 and the 10 most significant bits being provided to select line decoder 604. Then, as the 12-bit address is incremented, each successive row is updated one sub-row at a time.

Figure 14:
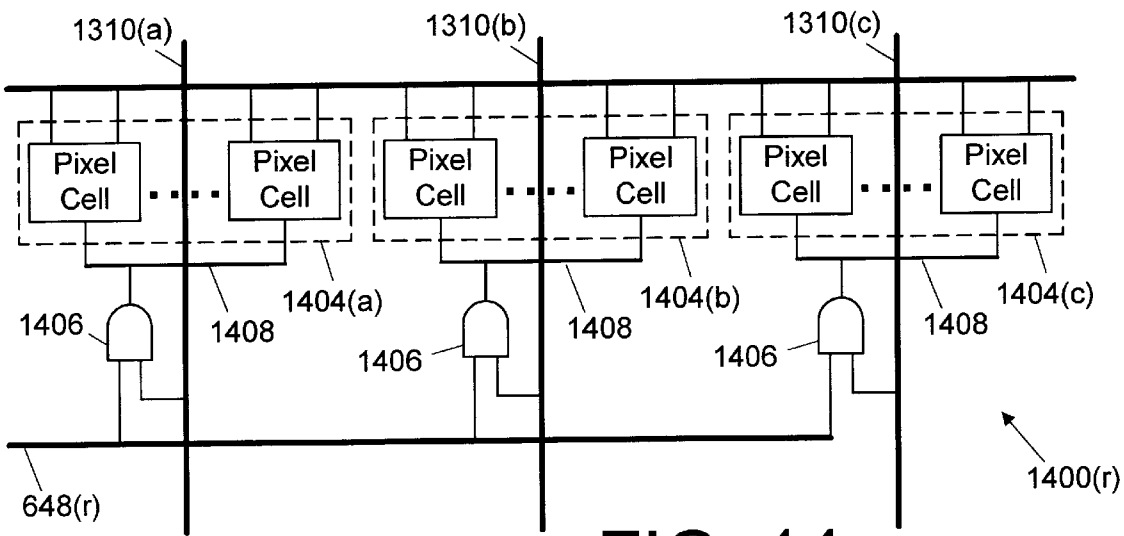
FIG. 14 is a block diagram showing one row of pixel cells of the display of FIG. 13.

FIG. 14 shows the organization of one row 1400(*r*) of pixel cells of display 1302. Row 1400(*r*) includes 3 sub-rows of pixel cells 1404(*a–c*), 3 AND gates 1406, and 3 local select lines 1408. Each AND gate 1406 has a first input terminal coupled to select line 648(*r*), a second input terminal coupled to an associated one of select sub-lines 1310(*a–c*), and an output terminal coupled to an associated one of local select lines 1408. Responsive to an update signal being asserted on its first and second input terminals by select line 648(*r*) and an associated one of select sub-lines 1310(*a–c*), each AND gate 1406 asserts an update signal on associated local select line 1408.

Those skilled in the art will understand that rows of pixel cells may be divided into a greater or lesser number of sub-rows. In the limiting case, the number of sub-rows is equal to the number of pixels in each row, each pixel constituting its own sub-row.

The description of particular embodiments of the present invention is now complete. Many of the described features may be substituted, altered or omitted without departing from the scope of the invention. For example, those skilled in the art will recognize that the embodiments described herein may be modified to drive displays having a greater or fewer number of rows (or sub-rows), by providing a sequencer capable of generating an appropriate address series and a corresponding number of select lines (or sub-lines). As another example, those skilled in the art will recognize that the display driver circuits described herein may be configured to receive select line addresses directly from a system, as opposed to receiving a select line address from a system by receiving a block address and then generating a select line address from the block address, as described herein.

We claim:

1. A display driver circuit for driving a display including an array of pixel cells, said display driver circuit comprising:

a plurality of write signal output terminals for providing write signals to said display to latch data into said display;

a select sequencer for providing at an output a series of select addresses;

a select address register for receiving an initial select address from a system and coupled to said select sequencer for providing said initial select address to said select sequencer; and a select decoder having an input, coupled to said output of said select sequencer, and a plurality of select signal output terminals, for decoding each said select address and asserting a pixel update signal on a corresponding one of said select signal output terminals, said pixel update signal on said one of said select signal output terminals causing the pixel cells of an associated row to assert the previously latched data onto their associated pixel electrodes.

2. A display driver circuit according to claim 1, wherein said select address register includes an input terminal for receiving another initial select address.

3. A display driver circuit according to claim 2, wherein:

said select sequencer includes a control input terminal;

said select sequencer outputs a next address of said series of select addresses responsive to receipt of a first control signal; and said select sequencer outputs a new series of select addresses starting from said another initial select address responsive to receipt of a second control signal.

4. A display driver circuit according to claim 2, wherein said another initial select address is different than said initial select address.

5. A display driver circuit according to claim 1, wherein:

said select sequencer includes a select sub-line sequencer for providing at an output a series of select sub-line addresses; and said select decoder includes a select sub-line decoder having an input, coupled to said output of said select sub-line sequencer, and a plurality of output terminals each coupled to a respective one of a set of said output terminals of said select decoder, for decoding each said select sub-line address and asserting an update signal on a corresponding one of said set of output terminals.

6. A display driver circuit according to claim 1, wherein said series of select addresses comprises a monotonic, increasing series.

7. A display driver circuit according to claim 1, wherein:

said select sequencer includes a select line sequencer for providing at an output a series of select line addresses; and said select decoder includes a select line decoder having an input, coupled to said output of said select line sequencer, and a plurality of output terminals each coupled to a respective one of a set of said output terminals of said select decoder, for decoding each said select line address and asserting an update signal on a corresponding one of said set of output terminals.

8. A display driver circuit according to claim 7, wherein:

said select sequencer further includes a select sub-line sequencer for providing at an output a series of select sub-line addresses; and said select decoder includes a select sub-line decoder having an input, coupled to said output of said select sub-line sequencer, and a plurality of output terminals each coupled to a respective one of a second set of said output terminals of said select decoder, for decoding each said select sub-line address and asserting an update signal on a corresponding one of said second set of output terminals.

9. In a display driver circuit for driving a display including an array of pixel cells, said display diver circuit having a plurality of write signal output terminals and a plurality of select signal output terminals, said display driver circuit coupled to a system which provides update commands and display addresses of blocks which are to be updated, a method for updating a display comprising the steps of:

asserting a series of write signals on said plurality of write signal output terminals to latch data into said display;

receiving a first initial select address from said system;

generating a series of select addresses based on said first initial select address;

decoding each of said select addresses of said series of select addresses; and asserting a series of pixel update signals on a first group of said plurality of select signal output terminals, each select signal output terminal of said first group corresponding to an associated select address, said pixel update signals on said first group of select signal output terminals causing the pixel cells of an associated row to assert the previously latched data onto their associated pixel electrodes.

10. A method according to claim 9, wherein said method for driving said display further comprises the steps of:

receiving another initial select address; and generating another series of select addresses based on said another initial select address.

11. A method according to claim 10, wherein said method for driving said display further comprises the steps of:

outputting said another initial select address;

generating a second select address based on said another initial select address; and outputting said second select address.

12. A method according to claim 10, wherein said step of receiving another initial select address includes the steps of:

receiving a block address from said system; and generating said another initial select address based on said block address.

13. A method according to claim 10, wherein said another initial select address is different than said first initial select address.

14. A method according to claim 9, wherein said step of generating a series of select addresses comprises the steps of:

outputting said initial select address responsive to a first update command;

generating a second select address based on said initial select address; and outputting said second select address.

15. A method according to claim 9, wherein said step of receiving said initial select address includes the steps of:

receiving a block address from said system; and generating said initial select address based on said block address.

16. A method according to claim 9, wherein said select addresses comprise select line addresses.

17. A method according to claim 16, further comprising the steps of:

generating a series of select sub-line addresses;

decoding each of said select sub-line addresses of said series of select sub-line addresses; and asserting an update signal on a second group of said plurality of output terminals, each output terminal of said second group corresponding to an associated select sub-line address.

18. A method according to claim 9, wherein said select addresses comprise select sub-line addresses.

* * * * *